United States Patent [19]

Gordin et al.

[11] Patent Number: 4,729,077

[45] Date of Patent: Mar. 1, 1988

[54] VARIABLE BEAM WIDTH LIGHTING DEVICE

[75] Inventors: Myron K. Gordin; James L. Drost, both of Oskaloosa, Iowa

[73] Assignee: Mycro Group Co., Oskaloosa, Iowa

[21] Appl. No.: 837,751

[22] Filed: Mar. 10, 1986

[51] Int. Cl.[4] ..... F21V 7/22; F21P 3/00

[52] U.S. Cl. ..... 362/285; 362/263; 362/306; 362/350

[58] Field of Search ..... 362/286, 288, 285, 277, 362/306, 350, 263, 346, 341, 296

[56] References Cited

U.S. PATENT DOCUMENTS

| | | | |
|---|---|---|---|
| 1,313,739 | 8/1919 | Ryerson | 362/306 |
| 1,512,158 | 10/1924 | Bragg et al. | 362/286 |
| 2,109,056 | 2/1938 | Bardwell et al. | 362/277 |
| 4,423,471 | 12/1983 | Gordin et al. | 362/350 |
| 4,602,321 | 7/1986 | Bornhorst | 362/285 |

FOREIGN PATENT DOCUMENTS

| | | | |
|---|---|---|---|
| 16225 | 7/1912 | United Kingdom | 362/350 |
| 395017 | 7/1933 | United Kingdom | 362/296 |

*Primary Examiner*—Andrew M. Dolinar

*Attorney, Agent, or Firm*—Zarley, McKee, Thomte, Voorhees & Sease

[57] ABSTRACT

A variable beam width lighting device including a luminaire assembly having a luminaire fixture to which are operatively mounted a reflector and a lamp and to which is operatively supplied electrical power to produce a light beam. An adjustable lamp positioning means is mounted between the lamp and the luminaire fixture. The adjustable lamp positioning means is responsive to a power means to move the lamp relative to the reflector to vary the width of the light beam between a narrow beam and a wide beam according to choice. The reflecting properties of the reflector are varied to produce smooth transition characteristics when the beam width is changed.

19 Claims, 7 Drawing Figures

VARIABLE BEAM WIDTH LIGHTING DEVICE

BACKGROUND OF THE INVENTION

1. Field of the Invention

The present invention relates to a variable beam width lighting device, and in particular, a luminaire assembly which has structure which allows movement of the lamp with respect to the reflector to vary beam width between a spot beam and a flood beam.

2. Problems in the Art

In many lighting applications, it would be advantageous to be able to control the beam width of the lighting device. In some instances, a narrow spot beam would be desirable, whereas in other situations, a diverse flood beam would be most useful. Furthermore, many times it would be desirable to have the ability to alter the beam characteristic produced by the lighting device instantaneously, and easily.

Lighting applications where such beam adjustability would be advantageous includes movie lighting, sports lighting, promotional activities, and other productions. While adjustable beam width lighting would prove useful in many diverse applications, it is particularly useful where large amounts of light are needed thus requiring large fixtures and high powered lamps.

Various methods have been attempted in the past to produce a variable beam luminaire assembly. In some of these attempts, the reflector is movable with respect to the lamp. Others utilize two lamps fixed at different positions with regard to the reflector and which can alternately be used. The problems and impracticalities of these various methods become acute when applied to large, high powered luminaire assemblies.

Many previous methods tried to accomplish variable beam lighting to some extent. However, there still exists a real need for a variable beam width lighting device which produces a maximum amount of light to a target area whether in a spot beam or flood beam mode, or anywhere in between; and at the same time a light device which involves a minimum of structure, expense, weight, and complexity. Furthermore, there is a need for such a device which is easily and efficiently operable, even from a remote location, to adjust the beam width to a desired width anywhere between spot beam and flood beam. It is also desirable to have a device which allows smooth transition between spot beam and flood beam. Previous attempts at producing a variable beam with smooth transitions have not been satisfactory. Some devices utilized reflectors with specular surfaces. However, transition from spot to flood beam was not smooth. Alternating areas of high and low intensity light were produced. The beam pattern consisted of a spotty bright center with alternating concentric bright and dark rings. Other devices, to achieve a more uniform intensity beam pattern, utilized a reflector with a diffuse surface. However, this does not allow enough candlepower or an adequate spot beam to be generated.

It is therefore a primary object of the present invention to provide a variable beam width lighting device which improves over or solves the problems in the art.

Another object of the invention is to provide a variable beam width lighting device which can, according to desire, produce a light beam of high intensity which can be adjusted in width between a spot beam and a flood beam.

Another object of the invention is to provide a variable beam width lighting device which produces a smooth transition between different light beam widths.

A further object of the invention is to provide a variable beam width lighting device which is efficient, economical, durable, and simple in structure and operation.

These and other objects, features, and advantages of the invention will become further apparent with reference to the accompanying specification and claims.

SUMMARY OF THE INVENTION

The present invention comprises a luminaire assembly which is capable of producing a light beam which is variable in width. The luminaire assembly can be adjusted, according to desire, between and including a spot beam and a flood beam. The adjustability of the beam is instantaneous and the transition during adjustment is smooth without loss of light or a spotty beam pattern. The present invention produces the variable width beam while maintaining the maximum amount of light to the target area.

A luminaire fixture has means to adjustably secure the fixture to a support and a reflector mounted to it. A lamp is operatively positioned within the fixture and is adjustably secured to the fixture by an adjustable lamp positioning means. Appropriate electrical power is supplied to the lamp and a motor means is operatively connected to the adjustable lamp positioning means. Operation of the motor means causes the adjustable positioning means to move the lamp with respect to the reflector thereby changing the width of the beam produced by the luminaire assembly.

The reflector can be specially constructed so that its inner reflecting surface varies in its light dispersing properties. For example, the innermost portion of the reflector can be manufactured to have less light dispersing properties and a more specular surface than the outer portion of the reflector. By varying the light dispersing properties of the reflector in this way, transition of the reflected beam will be smooth as the lamp is moved with respect to the reflector in changing beam widths. This surface can be made to gradually vary from specular to light-dispersing to achieve smooth transition of the variable light beam.

DETAILED DESCRIPTION OF THE PREFERRED EMBODIMENT

Figure 1:
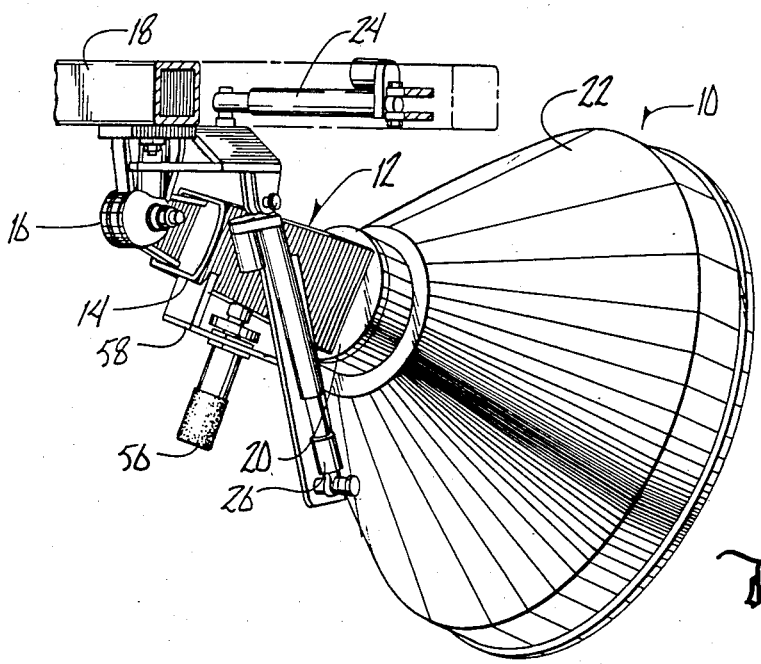
FIG. 1 is a rear and side perspective view of the invention.

With reference to the drawings, and in particular FIG. 1, a variable beam width lighting device 10, according to the invention, is depicted. A luminaire fixture 12 at its rearward end 14 is adjustably secured to a mounting bracket 16 which in turn is secured to a mounting beam 18.

The forward end 20 of fixture 12 has a reflector 22 securely mounted to it. It is to be noted that adjustably extendable gear motors 24 and 26 are appropriately connected between mounting beam 18 and fixture 12 to provide for either tilting adjustment (vertical) or panning adjustment (horizontal) of lighting device or luminaire assembly 10. These adjustment features do not form a part of the present invention, but are contained in the co-owned, and co-pending application Ser. No. 880,187 entitled "Remote Control, Moveable Lighting System" filed June 30, 1986, by the present inventors.

Figure 2:
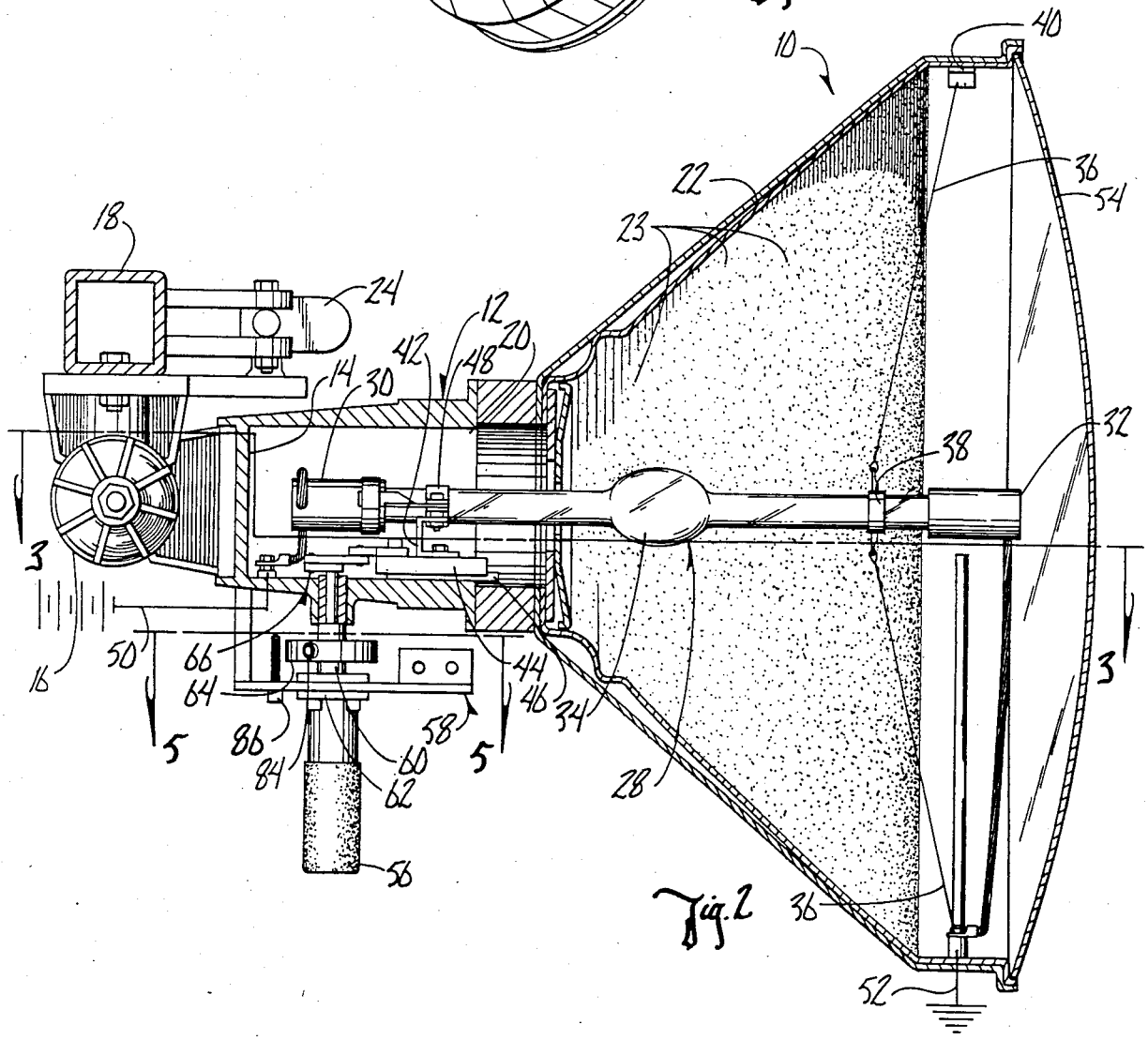
FIG. 2 is a sectional side elevational view of the invention.

By referring to FIG. 2, it can be seen that a lamp 28 is positioned so that its inner end 30 is secured within the inside of fixture 12, its outer end 32 extends axially and outwardly to the plane of the outer edge of reflector 22, and its arc chamber 34 is positioned generally within the reflector 22. In the preferred embodiment of the invention, outer end 32 of lamp 28 is suspended by damped wires 36 which extend from ring bracket 38 on lamp 28 to spring clips 40 secured to the reflector 22 at spaced apart positions. This mounting arrangement, first, cushions lamp 28 and provides shock absorbing properties, and also allows axial movement of lamp 28.

The inner end of lamp 28 is secured by mounting bracket 42 to a carriage 44 which is adjustably movable along a base member 46 which is rigidly secured to fixture 12. The manner of attachment of lamp 28 to mounting bracket 42 can be accomplished in a number of ways, but it is preferred that a second ring bracket 38 be used around the diameter of the inner end 30 of lamp 28.

It is to be understood that lamp 28 includes conventional features of double-ended, 6000 Watt, medium arc-length, metal-halide, high-intensity discharge lamps, including electrical power wires 50 and 52 which, in operation, are operatively connected to an appropriate electrical power source (not shown). Lamps of this nature are available from OSRAM, GmbH, Munich, Germany; ILC Technology, Inc., Sunnyvale, Calif.; and others. Also, it is noted that a transparent shield 54, usually of glass, is conventionally secured to the outer open end of reflector 22.

A motor 56 is mounted in motor mount 58 which is secured to fixture 22. Motor 56 includes a drive shaft 60 which rotates in either direction according to operation of motor 56. Drive shaft 60 extends from motor 56 through a bearing journal 62 in fixture 22, ending in the interior of fixture 22. A flywheel 64 is secured to drive shaft 60 intermediate of motor 56 and fixture 22 and rotates in kind with drive shaft 60.

Motor 56 is a small DC motor, such as is known in the art and commonly available. It is connectable to an appropriate power source by appropriate connection means (not shown). Operation of motor 56 causes carriage 44 to move by virtue of transfer linkage 66.

Transfer linkage 66 includes drive shaft arm 68 which is connected at one end to drive shaft 60 and has an outer end 70 which extends perpendicularly outwardly from the end of drive shaft 60. A middle arm 72 is hingedly attached at an end 74 to outer end 70 of drive shaft arm 68 by pin 76. Middle arm 72 is connected at its other end 78 by a pin 80 to a carriage arm 82. Thus, rotational movement of drive shaft 60 is translated into linear movement of carriage 44 by transfer linkage 66.

The forward and backward limits of movement of carriage 44 are determined by end limit stops 84 positioned on the perimetric edge of flywheel 64. A blocking bolt 86 extends through motor mount 58 a sufficient distance that it will come into contact with end limit stops 84 as flywheel 64 rotates, as shown in FIG. 2.

To enhance the smooth transition of the beam emanating from reflector 22, as lamp 28 is moved, the preferred embodiment includes a special surface on the inside reflecting surface of reflector 22. As shown by the density of dots or speckles 23 in FIG. 2, the innermost portion of reflector 22 is more polished or specular than the outer portion. The speckles or dots 23 represent the light-dispersing properties of those portions of reflector 22. By gradually making the reflecting surface of reflector 22 less specular and more light-dispersing the further out towards the outer edge of reflector 22, the better and smoother the transition of the beam from spot to flood can take place.

In the preferred embodiment, reflector 22 is a parabolic reflector. This being the case, the further arc chamber 34 is moved towards the fixture end of reflector 22, the more diverging the reflected beam rays will become, thereby forming the flood beam. Movement of arc chamber 34 away from fixture 12 and towards the outer edge of reflector 22 converts the reflected rays to be more converging in nature and therefore produces a spot beam. Since the flood beam is desired to have as much dispersion of light as possible, the outer portion of reflector 22 is made more light-dispersing. In contrast, when a spot beam is desired, the reflecting properties are desired to be precise and non-dispersed. The combination of the movable lamp 28 with the variable reflecting surface of reflector 22, produces variable beam width lighting capabilities which overcome previous problems and deficiencies in the art.

It is to be understood that the angular change of the position of lamp 28 as to reflector 22, when lamp 22 is moved, is greater when lamp 28 is closer to the fixture end of reflector 22. That is, when lamp 22 is retracted towards the fixture, very small movements produce much bigger changes in reflection of light rays from lamp 28 at that portion near lamp 28 (the innermost portion of the reflector). However, small changes in the position of lamp 28 do not to the same extent affect the reflecting properties at the outer portion of reflector 22 because it is at a greater distance from lamp 28.

The controlled dispersion of light at the outer portions of reflector 22 (by means of the dispersing surface) allows the matching of beam dispersion from the more specular inside portion of reflector 22. This causes the smooth transition from a narrow (spot) to a wide (flood) beam without the "spotty" bright center or the dark "doughnut shaped" or rings associated with a specular reflector, or the inability to obtain a very narrow or spot beam from a diffuse reflector.

Figure 3:
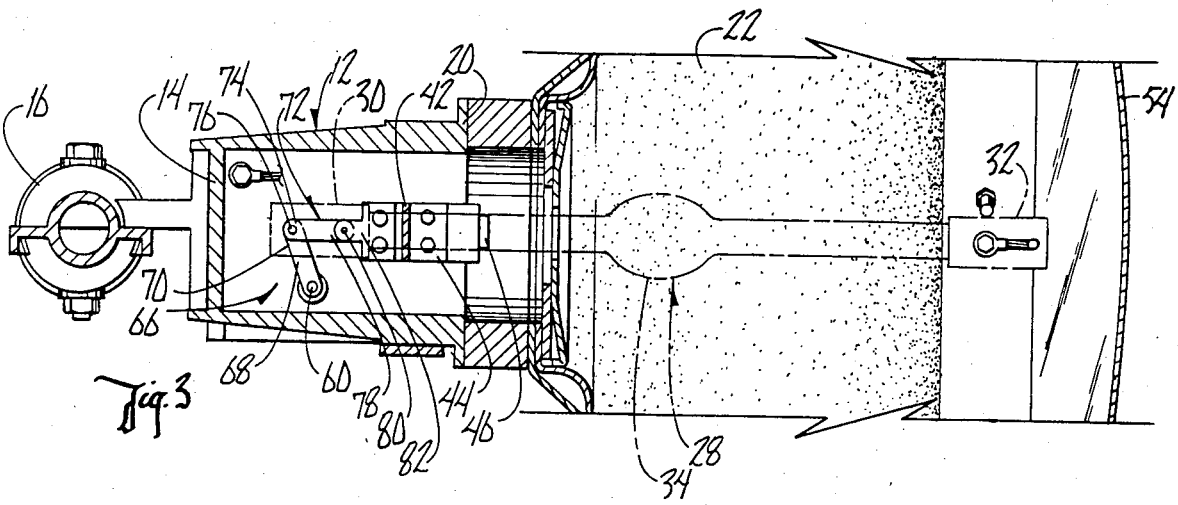
FIG. 3 is a partial top sectional view of the invention showing the lamp in a rearward or retracted position to produce a wider beam.
Figure 4:
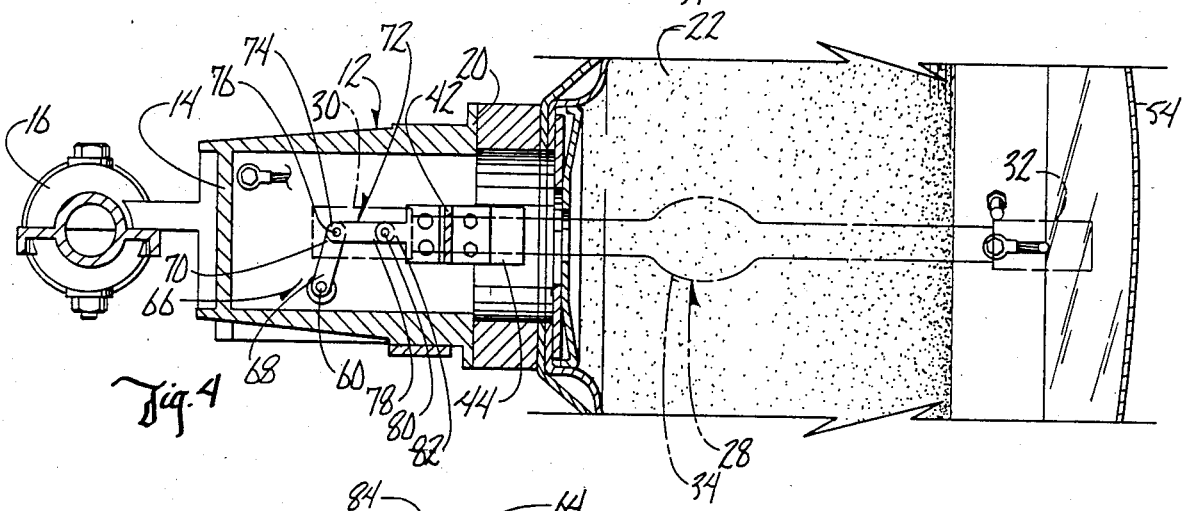
FIG. 4 is identical to FIG. 3, except the lamp is shown in an extended position for producing a narrow beam.

FIGS. 3 and 4 show the exact manner in which transfer linkage 66 cooperates with carriage 44 to move lamp 28 from the spot beam position (FIG. 3) to the flood beam position (FIG. 4).

Figure 5:
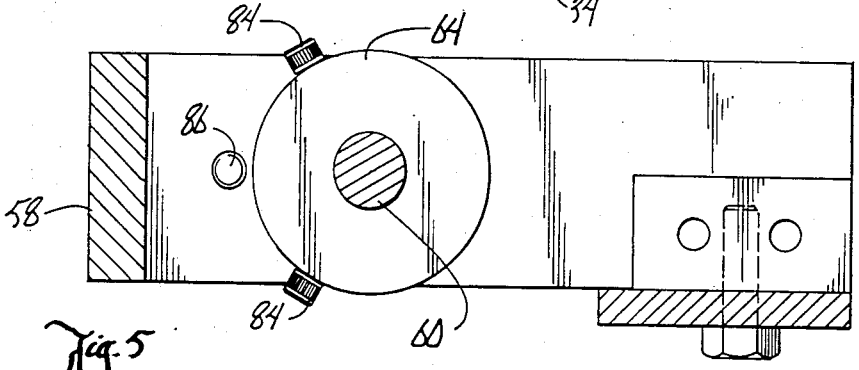
FIG. 5 is a partial top sectional view showing the mechanism for determining the end limit movement of the lamp between retracted and extended positions.

FIG. 5 specifically depicts flywheel 64 and end limit stops 84 in their relationship to blocking bolt 86. The position of end limit stops 84 can be adjusted which in turn would adjust the distance carriage 44 could travel. Correspondingly, the distance that lamp 28 could be axially adjusted can be modified to change the amount of variation possible for beam width of luminaire assembly 10.

Figure 6:
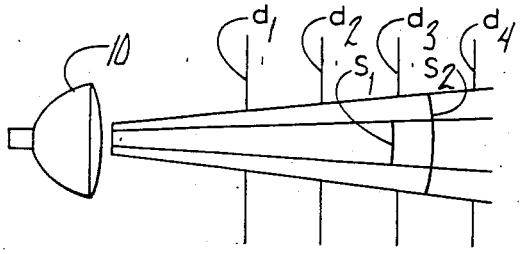
FIG. 6 is a schematic diagram depicting beam width for a narrower spot beam.
Figure 7:
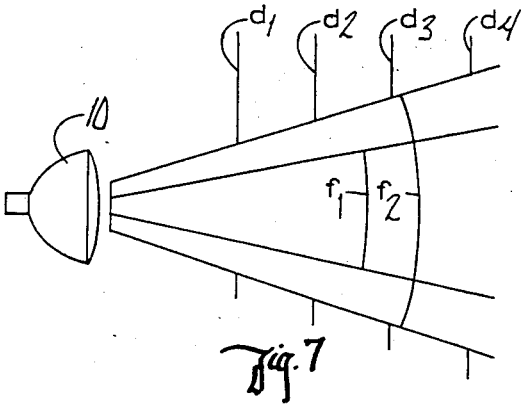
FIG. 7 is a schematic representation of the invention depicting wide and flood beams.

FIGS. 6 and 7 schematically compare the beam patterns of the luminaire assembly 10 according to the invention for a spot beam (FIG. 6) and a flood beam (FIG. 7). Chart 1 below sets forth the data for spot and flood beams, respectively. A 6,000 watt medium arc-length metal-halide, high intensity discharge 300 hour, 5600° K. lamp was utilized. For the spot focus, angle $S_1$, the one-half peak candlepower or beam angle (referred to below as one-half peak angle), equals 7°, whereas angle $S_2$, the one-tenth peak candlepower or field angle (referred to below as one-tenth peak angle), equals 18°. The data for the spot focus, as shown in chart 1, were determined as follows:

$$\text{Footcandles} = \frac{11{,}000{,}000}{\text{Distance}^2\ (\text{Ft})}$$

$$LUX = \frac{11{,}000{,}000}{\text{Distance}^2\ (\text{m})}$$

1/10 Peak Diameter = Distance × .32

½ Peak Angle = the point where intensity drops to 50% of maximum

1/10 Peak Angle = point where intensity drops to 10% of maximum

For the flood focus of FIG. 7, angle $F_1$ equals 62° and angle $F_2$ equals 100°. Similarly, data for chart 1 for flood focus in FIG. 7 was derived as follows:

$$\text{Footcandles} = \frac{400{,}000}{\text{Distance}^2\ (\text{Ft})}$$

$$LUX = \frac{400{,}000}{\text{Distance}^2\ (\text{m})}$$

1/10 Peak Diameter = Distance × 2.38

½ Peak Angle = point where intensity drops to 50% of maximum

1/10 Peak Angle = point where intensity drops to 10% of maximum

CHART 1

| | SPOT (½ Peak Angle 7°) FOCUS (1/10 Peak Angle 18°) | | | | FLOOD (½ Peak Angle 62°) FOCUS (1/10 Peak Angle 100°) | | | |
|---|---|---|---|---|---|---|---|---|
| | $d_1$ | $d_2$ | $d_3$ | $d_4$ | $d_1$ | $d_2$ | $d_3$ | $d_4$ |
| Distance-Feet | 50' | 75' | 100' | 125' | 50' | 75' | 100' | 125' |
| Footcandles | 4400 | 1955 | 1109 | 705 | 160 | 71 | 40 | 26 |
| 1/10 Peak Dia. | 15' | 23' | 31' | 38' | 120' | 180' | 240' | 300' |
| Distance-Meters | 15 m | 23 m | 30 m | 38 m | 15 m | 23 m | 30 m | 38 m |
| LUX | 44000 | 19550 | 11000 | 7050 | 1600 | 7100 | 400 | 2600 |
| 1/10 Peak Dia. | 4.7 m | 7.0 m | 9.3 m | 11.6 m | 36 m | 55 m | 73 m | 90 m |

The included preferred embodiment is given by way of example only, and not by way of limitation to the invention, which is solely described by the claims herein. Variations obvious to one skilled in the art will be included within the invention defined by the claims.

For example, various types of structure could be used to make up the adjustable lamp positioning means which in the preferred embodiment includes carriage 44 and base member 46 in combination with motor 56. Various types of motors can be used, but it is noted that in the preferred embodiment, motor 56 is a small DC motor which has sufficient force to move lamp 28 back and forth, but when end limit stops 84 encounter blocking bolt 86, the motor, after verifying that it is an end limit, slips or stops avoiding damage to both motor 56 and any other portion of luminaire assembly 10.

In the preferred embodiment, the reflecting surface of reflector 22 is varied in its light dispersing properties by imparting to it a two-part finish. For example, one preferred embodiment manufactures the first part of the reflector between the fixture and the middle of the reflector by anodizing the surface which takes impurities out and creates some smoothing. The surface is then coated with anodize. It is preferred that this portion of the reflector, though not being perfectly specular, produce a beam dispersion of approximately 3°.

The front part of the reflector, on the other hand, can be produced by putting another reflector, spun on a different chuck, in that position. Other methods of making this front surface more light-dispersing can be utilized as is known in the art. This front portion should have either a more grainy pattern or an indented surface and can be produced by not polishing the reflector, but simply putting it in a brightening bath. It is preferred that the beam spread of this front portion be close to 15° or at least triple that of the fixture adjacent portion. If an indented surface is used, the radiuses of the indentations are gradually varied from back to front of the reflector to produce the variance in light dispersing properties.

As previously stated, this varying surface finish smooths the transition of the beam when moved from spot to flood. High and low intensity areas common with adjusting a lamp without this type of surface are eliminated. Additionally, this smooth beam transition method utilized with the efficient parabolic reflector, produces almost double the amount of light and traditional fresnel lens fixtures. With the example of the lamp used in Chart 1, the present invention can generate up to 11,000,000 candlepower for a spot beam.

What is claimed is:

1. In a luminaire assembly for high power, high intensity lighting applications, comprising a luminaire fixture to which are operatively mounted a reflector having, an innermost center portion and an outermost peripheral portion, and a high power, high intensity lamp, and to which is operatively supplied electrical power to produce a light beam, the improvement comprising:

an adjustable lamp positioning means mounted between said luminaire fixture and said lamp and being responsive to a power means to move said lamp relative to said reflector to vary the width of said light beam between a narrow beam and a wide beam according to choice; and variable reflector surface light dispersing means associated with the reflector to present a reflecting surface which is generally specular at the innermost center portion but becomes gradually increasingly less specular and more light dispersing towards the outermost peripheral portion of the reflector to produce smooth and complete transition of the light beam when the lamp is moved relative to the reflector.

2. The means of claim 1 wherein said lamp positioning means comprises:

a base member secured to said luminaire fixture;

a carriage means secured to said lamp, said carriage means being movable in response to a power means along said base member.

3. The means of claim 1 wherein said power means comprises a motor means operatively connected to said carriage means.

4. The device of claim 1 wherein said power means is remotely operable.

5. The device of claim 1 wherein said narrow beam is a spot beam.

6. The device of claim 1 wherein said wide beam is a diverging flood beam.

7. The device of claim 1 wherein said reflector has a reflecting surface with at least two portions having different light-dispersing properties.

8. The device of claim 1 wherein said reflector has an reflecting surface with an inner end adjacent to said fixture, and an opposite outer end away from said fixture, said reflecting surface having greater light-dispersing properties at said outer end than at said inner end.

9. The device of claim 8 wherein the light-dispersing properties gradually increase between the inner and outer ends of the reflecting surface of said reflector.

10. The device of claim 1 wherein said reflector is parabolic in shape.

11. The device of claim 1 wherein said lamp is axially mounted within said reflector.

12. The device of claim 2 wherein said lamp is a double-ended medium arc-length, metal-halide, high-intensity discharge lamp.

13. The device of claim 12 wherein one end of said lamp is secured to said carriage means, said opposite end of said lamp extending axially outward towards the outer plane of said reflector.

14. The device of claim 13 wherein said opposite end of said lamp is secured to said reflector by dampened and resilient mounting means.

15. The luminaire assembly of claim 1 wherein the variable reflector surface light dispersing means comprises an inner surface of the reflector which is highly polished for its more specular portions, and less polished for its less specular portions.

16. The luminaire assembly of claim 1 wherein the variable reflector surface light dispersing means comprises an inner reflecting surface which is machined to produce the gradually changing light dispersing qualities of the reflector.

17. The luminaire assembly of claim 1 wherein the variable reflective surface light dispersing means comprises an inner reflective surface which is chemically processed to produce gradually changing light dispersing qualities of the reflector.

18. The luminaire assembly of claim 1 wherein the variable reflective surface light dispersing means comprises an inner reflective surface which varies in its graininess.

19. The luminaire assembly of claim 1 wherein the variable reflective surface light dispersing means comprises an inner reflective surface which includes various concentrations of small indentations which correspondingly vary the light dispersing qualities of particular locations on the inner reflective surface.

* * * * *